US006855383B2

(12) United States Patent
Jung et al.

(10) Patent No.: US 6,855,383 B2
(45) Date of Patent: Feb. 15, 2005

(54) PRINTING MEDIUM

(75) Inventors: Taek-yong Jung, Suwon (KR); Seung-min Ryu, Gunpo (KR); Jae-hwan Kim, Sungnam (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/298,598

(22) Filed: Nov. 19, 2002

(65) Prior Publication Data

US 2003/0124273 A1 Jul. 3, 2003

(30) Foreign Application Priority Data

Jan. 3, 2002 (KR) ..... 2002-315

(51) Int. Cl.[7] ..... B41M 5/40

(52) U.S. Cl. ..... 428/32.26; 428/32.27; 428/32.28; 428/32.34

(58) Field of Search ..... 428/32.26, 32.27, 428/32.28, 32.34

(56) References Cited

U.S. PATENT DOCUMENTS 6,214,458 B1 * 4/2001 Kobayashi et al. ..... 428/32.5
6,387,473 B1 * 5/2002 Sismondi et al. ..... 428/32.34

FOREIGN PATENT DOCUMENTS

EP 826508 A1 * 3/1998 ..... B41M/5/00

* cited by examiner

*Primary Examiner*—B. Shewareged
(74) *Attorney, Agent, or Firm*—Staas & Halsey LLP

(57) ABSTRACT

A printing medium has a base layer, an ink receptive layer coated on the base layer, and an undercoating layer formed between the base layer and the ink receptive layer. The undercoating layer has a highly glossy resin property. Accordingly, regardless of a type of a material that is used in the base layer, the printing medium always offers rapid ink absorption, a vivid color image, excellent color fixation, a high water and light resistance, and high glossiness.

8 Claims, 1 Drawing Sheet

PRINTING MEDIUM

CROSS-REFERENCE TO RELATED APPLICATIONS

This application claims the benefit of Korean Patent Application No. 2002-315, filed Jan. 3, 2002, in the Korean Intellectual Property Office, the disclosure of which is incorporated herein by reference.

BACKGROUND OF THE INVENTION

1. Field of the Invention

The present invention generally relates to a printing medium, and more particularly, to an inkjet photo-printing medium having a rapid ink absorption, a vivid color image, superb color fixation, a high water and light resistance, and glossiness.

2. Description of the Related Art

An inkjet printing apparatus forms an image on a printing medium by jetting fluid ink onto the printing medium through nozzles. The inkjet printing apparatus is very popular due to advantages that the inkjet printing apparatus makes little noise during a printing process and is easy to print a color image. The inkjet printing apparatus also has advantages in that the inkjet printing apparatus has a rapid output speed and is offered an economical price. The inkjet printing apparatus is thus widely applied to many printing devices like printers, facsimiles and plotters.

A general printing medium, which is effectively used in the inkjet printing apparatus having the above characteristics, is made by applying an ink receptive layer on a surface of a base layer like a sheet of paper made from an initial processing on pulp. The ink receptive layer has a characteristic that enables it not only to absorb liquid ink sufficiently but also to clarify a picture image. The ink receptive layer is disposed on the base layer as an applicator is applied to the surface of the base layer. The applicator is made as a pigment, such as silica, and is distributed within a binder resin like a polyvinyl alcohol.

Various printing media are used in the inkjet printing apparatus, including a regular paper, a special-purpose coated paper, a special-purpose film, and a photo printing medium. A inkjet photo printing medium is made by coating a substance, which has superior ink absorption and fixation and a high liquid and light resistance, onto the base layer of the printing medium like one-sided or double-sided art paper, cast coated paper, and photographic paper. The printing medium is used in printing digital photos or images through a thermal type, piezo type or phase change-type inkjet printing apparatus. The printing medium is also used in other applications like outdoor decorations, designs or advertisement.

Here are a few examples of such an inkjet-printing medium. U.S. Pat. No. 5,866,268, entitled Liquid sorptive coating for ink jet recording media to ARKWRIGHT INC., and the Japanese Patent publication No. 55-144172, entitled Ink jet recording method to FUJI PHOTO FILM CO., LTD., disclose a recording medium using a hydrophilic binder like copolymer of cellulose derivative and polyvinyl alcohol. The disclosed recording medium, however, has a shortcoming of a weak liquid resistance that causes a printed image often to gravitate and be blurred especially when the recording medium is put under water within ten (10) minutes after the printing. Japanese Patent Publication No. 59-198186 entitled Recording material to Canon KK discloses the use of the recording medium using organic acid salt of polyethyleneimine to improve the water resistance. There are, however, problems of deteriorating heat and light resistance and subsequent yellowing of the recording medium by an ultraviolet (UV) light.

Japanese Patent publication No. 60-232990 entitled Inkjet recording medium to MITSUBISHI SEISHI and Japanese Patent Publication No. 6-199035 entitled Material on which recording is made to ASAHI GLASS CO., LTD., also disclose the recording medium using both an alumina hydrate and a water soluble binder, which has a superb water resistance and a glossiness but with a shortcoming of deteriorating ink absorption.

SUMMARY OF THE INVENTION

The present invention has been made to overcome the above and other problems of the prior art, and accordingly, it is an object of the present invention to provide an inkjet photo printing medium having a rapid ink absorption, a vivid color image, excellent color fixation, a high water and light resistance, and glossiness.

Additional objects and advantageous of the invention will be set forth in part in the description which follows and, in part, will be obvious from the description, or may be learned by practice of the invention.

In order to achieve the above and other objects, a printing medium, e.g., an inkjet photo printing medium formed by coating an ink receptive layer on a base layer, has an undercoating layer coated between the base layer and the ink receptive layer. The undercoating layer is formed of a coating composition (material) that contains a resin of high glossiness.

As the undercoating layer containing the resin of the high glossiness is coated thereon, the photo printing medium according to the present invention can have an improved glossiness and a light resistance irrespective of a material that constitutes the base layer.

The coating composition of the undercoating layer includes a curing agent and a resin containing one of an acrylic line, a polyurethane line, a vinyl line, and a polyolic line, or a compound of any combination of the acrylic line, the polyurethane line, the vinyl line and the polyolic line . The undercoating layer has a thickness from 0.1 to 5 $\mu$m. The coating composition of the undercoating layer includes one of additives, such as a whitening agent, a UV blocking agent, a fluorescent dye, a talc, a titanium oxide, an antioxidant, a lubricant, and a surface active agent, or a compound of any combination of the additives. By adding the additives, such as the UV blocking agent or the antioxidant, to the coating composition of the undercoating layer, a light resistance of the base layer improves, and as a result, the light resistance of the printing medium improves.

An ink receptive composition (material) of the ink receptive layer includes an aqueous polymer. The aqueous polymer of the ink receptive layer includes one of a polyvinyl alcohol, a polyvinyl pyrrolydone, a cellulose, a gelatin, a polyethylene oxide, an acrylic polymer, a polyester, a polyurethane polymer and a copolymer in quaternary ammonium, or a compound of any combination of the polyvinyl alcohol, the polyvinyl pyrrolydone, the cellulose, the gelatin, the polyethylene oxide, the acrylic polymer, the polyester, the polyurethane polymer and the copolymer in quaternary ammonium.

The ink receptive composition of the ink receptive layer includes an inorganic filler which is either a microporous silica sol or a microporous alumina sol, both having a size from 20 nm to 200 nm. According to an aspect to the present invention, an amount of the inorganic filler is more than 100% of a polymer content that is contained in the ink receptive layer.

According to another aspect of the present invention, the printing medium always has the high glossiness irrespective of the material that constitutes the base layer.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
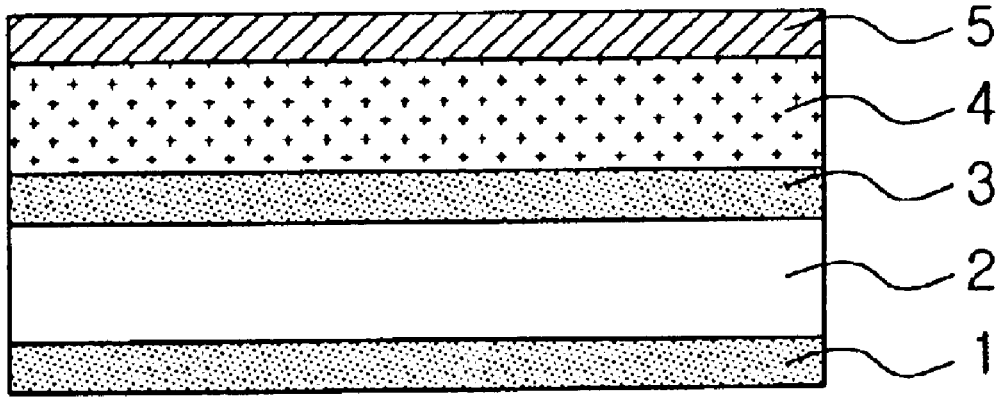
FIG. 1 is a sectional view showing an inkjet photo printing medium according to an embodiment of the present invention.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

From now on, the present invention will be described in greater detail by referring to the appended drawing.

FIG. 1 is a sectional view showing a printing medium, e.g., an inkjet photo printing medium, according to an embodiment of the present invention. In the printing medium, an ink receptive layer 4 is coated on a base layer 2, on a sheet of paper. Also, in the printing medium, an undercoating layer 3 is coated between the ink receptive layer 4 and the base layer 2. A bottom coating layer 1 can be coated on a bottom side of the base layer 2, or an ink penetrating layer 5 can be coated on the ink receptive layer 4 as necessary. The bottom coating layer 1 and the ink penetrating layer 5 serve as a function of a protective layer.

Generally, one-sided or double-sided art paper, cast coated paper, or photographic paper is used for the base layer 2. The base layer 2 preferably has a surface density of 75~300 g/m$^2$ for an easy handling and prevention of bending during a drying process after coating. Appropriate films like a polyester (polyethylene terephthalrate) film, a polycarbonate film or a cellulose acetate film can also be used as the base layer 2 according to a usage of the printing medium.

The undercoating layer 3 reinforces a binding force between the base layer 2 and the ink receptive layer 4. In the present invention, the printing medium having superb glossiness is always provided regardless of a material type of the base layer 2, as the highly glossy resin is used in a coating composition (coating material) of the undercoating layer 3. If a UV blocking agent and an antioxidant are added to the coating composition of the undercoating layer 3, vulnerability of the base layer 2 to light decreases and accordingly, the printing medium has an improved light resistance.

Conventionally, a whitening agent or pigment was added to the ink receptive layer 4 in order to increase whiteness of the printing medium. However, it caused a yellowing phenomenon both in the printed and non-printed areas of the printing medium. According to the present invention, such problem is solved as the whitening agent or pigment is added to the undercoating layer 3. By adding the whitening agent or pigment to the undercoating layer 3, the whiteness of the photo printing medium increases while the light resistance increases as the external influence decreases.

The coating composition of the undercoating layer 3 can include a polyolic line resin, polyurethane resin, acrylic resin, vinyl resin, and a polyisocyanate line curing agent. The coating composition of the undercoating layer 3 can also be used for the paper like art paper, cast coated paper, photographic printing paper, and used for the films like polyolefine films such as polypropylene film and polyethylene film, and a polyethylene terephthalrate film. The coating composition of the undercoating layer 3 is compatible to a water-soluble or hydrophilic resin (content) for an ink receptive composition of the ink receptive layer 4 and a filler. The undercoating layer 3 preferably has a thickness of 0.1~5 $\mu$m, and more preferably 0.5~2 $\mu$m. The coating of the undercoating layer 3 can be performed by many methods, preferably a gravure coating method.

A cellulose line or an acrylic polymer of appropriate molecular weight and superb ink absorption is used for increasing a binder property in the ink receptive composition of the ink receptive layer 4. Accordingly, polyvinyl alcohol, polyvinyl pyrrolidone, methyl cellulose, hydroxy propylmethyl cellulose, gelatin, polyethylene oxide, polyacryl acid, and polymethylmetaacrylrate can be used. A high polymer of polyester or polyurethane, or a copolymer in quaternary ammonium can also be used. Especially, the cationic substituent in the quaternary ammonium enhances an output of negative ion ink.

In order to further improve an ink absorbing ability of the printing medium and to prevent problems that could occur when the binder is used alone in the ink receptive layer 4, the filler is added in the ink receptive composition of the ink receptive layer 4. As for the filler, a silica sol or an alumina sol is preferred. By adding the filler in the ink receptive composition of the ink receptive layer 4, a high absorption and high color fixation can be achieved. However, the silica sol or alumina sol having particles that are bigger than 200 nm could deteriorate the glossiness. Also, the silica sol or alumina sol having particles that are smaller than 20 nm could deteriorate the ink absorption. Accordingly, a silica sol or alumina sol having particles 20~200 nm big is desired. However, even if the silica sol or alumina sol has the particles that are 20~200 nm big, there will be no ink absorption if the particles are in a spherical shape. Accordingly, the silica sol or alumina sol having microporous particles 20~200 nm big are most desired.

In order to improve a water resistance of the printing medium, a proportion of an inorganic filler to the water soluble or hydrophilic content should be 50:50~1:99, and more preferably, 30:70~5:95. However, that care must be taken, considering an excessive content of the inorganic filler will deteriorate the glossiness.

In addition to the inorganic filler, an additive can be included in the ink receptive composition of the ink receptive layer 4 to maintain characteristics of the ink receptive layer 4. For example, adding the fluorescent dye increases the whiteness perceived by human eyes. Adding the fluorescent dye in the ink receptive composition of the ink receptive layer 4 by 0.01~0.5% on a weight basis improves the whiteness of the photo printing medium. The pigment, a light diffusion agent, a pH-controller, the antioxidant, a defoaming agent, a leveling agent, a lubricant, an anti-curling agent and a surface active agent can also be used as the additives.

Since there is no variation in ink absorption and fixation only if the ink receptive layer 4 has a thickness above a certain range, the ink receptive layer 4 preferably has the thickness ranging from 8 to 40 $\mu$m.

Taking the environmental concerns and work efficiency into account, an aqueous solvent is preferable as a solvent for the ink receptive composition of the ink receptive layer 4. For example, water is generally used as the solvent for the ink receptive composition of the ink receptive layer 4. Beside the water, alcohol, glycol ether, and ketone can also be used as the solvent. It is preferred that alcohols like methanol, ethanol, isopropanol, and methylcerosolve having a defoaming property be used, keeping alcohol content less than 50% of the whole solvent.

The present invention will be described in greater detail with reference to the following examples. However, it is understood that the present invention is not limited thereto.

EXAMPLE 1

On the base layer 2, i.e., on a gelatin-treated photographic printing paper of 200 g/m$^2$, the undercoating layer 3 is coated on the base layer 2 to about 1 $\mu$m thick using a bar coater, and dried at 100° C. in an oven for one minute.

The coating composition of the undercoating layer 3 contains 90% of polyol (Brand name DL-505SA-1 of SINSUNG CHEMICAL IND. CO., LTD.), and 10% of polyisocyanate (SINSUNG CHEMICAL IND. CO., LTD.) on a weight basis.

The ink receptive composition of the ink receptive layer 4 is coated on a photographic paper, on which the undercoating layer 3 is coated, using the bar coater, and dried at 110° C. in an oven for three (3) minutes so that the ink receptive layer 4 can be 30 g/m$^2$ thick.

The ink receptive composition of ink receptive layer 4 contains 10% of polyvinyl alcohol (Brand name CM-318 of KURAREI CO., LTD.), 89% of silica sol (Brand name ST-PS-M of NISSAN CHEMICAL CO., LTD.), 0.5% of fixing agent (Brand name HANWET HF-59 of HANSOL CHEMIENCE), and 0.5% of glyoxal on a weight basis.

EXAMPLE 2

All other conditions are the same as the Example 1 except for the ink receptive composition of the ink receptive layer 4.

The ink receptive composition of the ink receptive layer 4 contains 10% of polyvinyl alcohol (Brand name CM-318 of KURAREI CO., LTD.), 89% of alumina sol (Brand name AS-520 of NISSAN CHEMICAL CO., LTD.), 0.5% of fixing agent (Brand name HANWET HF-59 of HANSOL CHEMIENCE) and 0.5% of glyoxal on a weight basis.

EXAMPLE 3

All other conditions are the same as the Example 1 except for the coating composition of the undercoating layer 3.

The coating composition of the undercoating layer 3 contains 95% of polyurethane (Brand name GPP-S506 of SINSUNG CHEMICAL IND. CO., LTD.) and 5% of polyurethane curing agent (SINSUNG CHEMICAL IND. CO., LTD.) on a weight basis.

EXAMPLE 4

All other conditions are the same as the Example 1 except for the coating composition of the undercoating layer 3.

The coating composition for the undercoating layer 3 contains 100% of acrylic primer (SAMYOUNG INK & PAINT) on a weight basis.

EXAMPLE 5

All other conditions are the same as the Example 1, except for the coating composition of the undercoating layer 3.

The coating composition of the undercoating layer 3 contains 95% of polyurethane (Brand name GPP-S506 of SINSUNG CHEMICAL IND. CO., LTD.), 4.5% of polyurethane curing agent (SINSUNG CHEMICAL IND. CO., LTD.), and 0.5% of whitening agent (Brand name UBITEX-OB of CIBA SPECIALTY CHEMICALS INC.) on a weight basis.

EXAMPLE 6

All other conditions are the same as the Example 1 except for the coating composition of the undercoating layer 3.

The coating composition of the undercoating layer 3 contains 95% of polyurethane (Brand name GPP-S506 of SINSUNG CHEMICAL IND. CO., LTD.), 4% of polyurethane curing agent (SINSUNG CHEMICAL IND. CO., LTD.), 0.5% of whitening agent (Brand name UBITEX-OB of CIBA SPECIALTY CHEMICALS INC.) and 0.5% of titanium oxide (Brand name WD 2002 of ELEMENTIS, PLC) on a weight basis.

Comparative Example 1

All other conditions are the same as the Example 1 except for the omission of the undercoating layer 3.

Comparative Example 2

All other conditions are the same as the Example 1 except for the undercoating layer 3 that is 5 $\mu$m thick.

Comparative Example 3

All other conditions are the same as the Comparative Example 1 except for the ink receptive composition of the ink receptive layer 4.

The ink receptive composition of the ink receptive layer 4 contains 10% of polyvinyl alcohol (Brand name CM-318 of KURAREI CO., LTD.), 89% of silica sol (Brand name ST-PS-M of Nissan Chemical), 0.5% of fixing agent (Brand name HANWET HF-59 of HANSOL CHEMIENCE), 0.5% of glyoxal, whitening agent (Brand name TINOPAL-IJT of CIBA SPECIALTY CHEMICALS INC.), and 0.2% of pigment (Brand name IRHALITE VIOLET of CIBA SPECIALTY CHEMICALS INC.) on a weight basis.

An evaluation of the printing medium according to the Examples 1 through 6 and Comparative Examples 1 through 3 in terms of ink absorption, whiteness, glossiness, water resistance and light resistance are listed in the tables 1 and 2 below.

Here, an image is printed on the paper by a color inkjet printer (Brand name HP 970 cxi of HEWLETT PACKARD) and a color inkjet printer (Brand name STYLUS PHOTO 1270 of EPSON).

TABLE 1

| | Ink absorption | Whiteness | Water resistance |
|---|---|---|---|
| Example 1 | 0 | 80 | 0 |
| Example 2 | 0 | 82 | 0 |
| Example 3 | 0 | 80 | 0 |
| Example 4 | 0 | 80 | 0 |
| Example 5 | 0 | 90 | 0 |
| Example 6 | 0 | 92 | 0 |
| Comparative Example 1 | 0 | 80 | 0 |
| Comparative Example 2 | X | 80 | Δ |
| Comparative Example 3 | 0 | 92 | 0 |

The ink absorption was tested by printing a rather dark colored image on an A4-sized examination segment, pressing a sheet of white paper on the image with a metal mess of 5 kg being placed thereon for 10 seconds, and then checking an amount of ink being blotted by the white paper sheet. As for the whiteness test, the BRIGHTIMETER MICRO S-5 marketed by the TECHNIDYNE COMPANY was employed. Also, the water resistance was tested by checking the amount of ink being erased as a 2.5 cm×5.0 cm printout was put under slowly whirling distilled water of a room temperature (approximately 25° C.) for about thirty (30) minutes.

TABLE 2

| | Glossiness | | Light resistance | |
|---|---|---|---|---|
| | 85° | 60° | HP | EPSON |
| Example 1 | 83 | 45 | 10% | 8% |
| Example 2 | 85 | 48 | 9% | 8% |
| Example 3 | 82 | 43 | 11% | 10% |
| Example 4 | 83 | 45 | 9% | 8% |
| Example 5 | 82 | 45 | 10% | 10% |
| Example 6 | 81 | 44 | 7% | 6% |
| Comparative Example 1 | 75 | 35 | 10% | 9% |
| Comparative Example 2 | 90 | 50 | 10% | 10% |
| Comparative Example 3 | 72 | 33 | 15% | 16% |

In the above table 2, the glossiness was tested by using the MICROGLOSS REF-160 Sheen Company, and the light resistance was tested by printing an image on a 2.5 cm×5.0 cm examination segment, leaving the printed examination segment in the MODEL NO. Ci 65 of ATLAS COMPANY for about ten (10) hours, and then measuring reduction of a color density of the image on the printed examination segment.

As shown in the above table 1, the Examples 1 through 4 show the superior ink absorption ability and the water resistance as compared with others. The examples 5 and 6, which employ the whitening agent on the undercoating layer 3, also show the excellent whiteness. As for the Comparative Example 2, the ink absorption ability and the water resistance deteriorate as a result of applying the undercoating layer 3 by 5 $\mu$m thick.

The above table 2 shows the test results showing the improvement of the glossiness and the light resistance. The Examples 1 through 6 show the glossiness which is greatly improved by employing the undercoating layer 3. As shown in the Example 2, employing the alumina sol results in the higher glossiness, compared with employing the silica sol. Adding the whitening agent to the coating composition of the undercoating layer 3 as in the Example 5 would increase the whiteness. However, the increase of the whiteness comes with a decrease of the light resistance by a certain extent. Also, adding the light resistance improving agent like titanium oxide as in the Example 6 will improve the light resistance.

The Comparative Example 1 does not include the undercoating layer 3, and therefore, it shows a considerable decrease of the glossiness. The Comparative Example 2, which has a rather thick undercoating layer 3, has an excellent glossiness. The Comparative Example 3, which adds the whitening agent and pigment onto the ink receptive layer 4 that is coated onto the surface of the printing medium, shows a considerably weak light resistance.

As described above, since the undercoating layer 3, which has a resin with the excellent glossiness, is formed within a proper thickness range prior to coating the ink receptive layer 4 to the base layer 2, the printing medium according to the present invention can offer a superb image display ability with the excellent ink absorption, the water resistance, the glossiness and the light resistance.

As a result, the printing medium according to the present invention offers advantages of the rapid ink absorption, the vivid color image, the excellent color fixation, the high water and light resistance, and the glossiness.

Although a few preferred embodiments of the present invention has been described, it will be understood by those skilled in the art that the present invention should not be limited to the described preferred embodiment, but various changes and modifications can be made within the spirit and scope of the present invention as defined by the appended claims and equivalents.

What is claimed is:

1. A printing medium, comprising:

a base layer;

an ink receptive layer made of an ink receptive material including an inorganic filler which is either a microporous silica sol or a microporous alumina both having a size from greater than 100 nm to 200nm; and an undercoating layer coated between the base layer and the ink receptive layer and formed of a coating material that contains a resin and a curing agent, and has thickness of between 0.1 to 5 $\mu$m, wherein the resin includes at least one of an acrylic line, a polyurethane line, a vinyl line, and a polyolic line, wherein the curing agent includes one of a polyisocyanate and a polyurethane, and wherein the ink receptive layer comprises a microporous alumina sol.

2. The printing medium of claim 1, the coating material of the undercoating layer comprises one of additives, and the additives comprises:

one or a compound of any combination of a whitening agent, a UV blocking agent, a fluorescent dye, a talc, a titanium oxide, an antioxidant, a lubricant, and a surface active agent.

3. The printing medium of claim 1, wherein the ink receptive material of the ink receptive layer comprises an aqueous polymer, and the aqueous polymer comprises:

one or a compound of any combination of a polyvinyl alcohol, a polyvinyl pyrrolydone, a cellulose, a gelatin, a polyethylene oxide, an acrylic polymer, a polyester, a polyurethane polymer and a copolymer in quaternary ammonium.

4. The printing medium of claim 1, wherein the ink receptive material of the ink receptive layer comprises an inorganic filler and a polymer, and an amount of the inorganic filler is more than 100% of a content of the polymer contained in the ink receptive layer.

5. The printing medium of claim 1, wherein the ink receptive material of the ink receptive layer comprises an additive, and the additive comprises:

one or a compound of any combination of a crosslink agent, a fluorescent dye, a talc, a titane oxide, a light diffusion agent, a pH controller, an antioxidant, a defoaming agent, a leveling agent, a lubricant, an anti-curling agent, and a surface active agent.

6. The printing medium of claim 5, wherein the crosslink agent comprises either one of an oxazoline, an isocyanurate, an epoxide, an azilydine, a melanin-formaldehyde, a glyoxal, and a dialdehide, or a compound of any combination of the oxazoline, the isocyanurate, the epoxide, the azilydine, the melanin-formaldehyde the glyoxal, and the dialdehide.

7. The printing medium of claim 1, wherein the base layer comprises:

one of an one-sided art paper, a double-sided art paper, a cast coated paper, a photography paper, a synthetic paper, a polyester, a polycarbonate, a cellulose acetate, and a polyethylene terephthalrate.

8. The printing medium of claim 1, further comprising:

a bottom coating layer coated on a bottom surface of the base layer opposite the undercoating layer.

* * * * *

UNITED STATES PATENT AND TRADEMARK OFFICE

CERTIFICATE OF CORRECTION

PATENT NO. : 6,855,383 B2
DATED : February 15, 2005
INVENTOR(S) : Taek-yong Jung et al.

It is certified that error appears in the above-identified patent and that said Letters Patent is hereby corrected as shown below:

Column 8,
Line 8, after “alumina” insert -- sol, --;
Line 12, after “has” insert -- a --;
Lines 49 and 52, change “isocyanurate” to -- isocyanate --; and
Line 53, after “melanin-formaldehyde” insert -- , --.

Signed and Sealed this

Sixth Day of December, 2005

JON W. DUDAS
*Director of the United States Patent and Trademark Office*